US007037183B1

(12) United States Patent
Troyer

(10) Patent No.: US 7,037,183 B1
(45) **Date of Patent: *May 2, 2006**

(54) FLOOR EDGER ADJUSTMENT TOOL

(76) Inventor: Kenneth Troyer, 50 S. Roosevelt St., Colorado Springs, CO (US) 80910

( * ) Notice: Subject to any disclaimer, the term of this patent is extended or adjusted under 35 U.S.C. 154(b) by 0 days.

This patent is subject to a terminal disclaimer.

(21) Appl. No.: 10/995,042

(22) Filed: Nov. 22, 2004

Related U.S. Application Data

(63) Continuation of application No. 10/002,490, filed on Nov. 14, 2001, now Pat. No. 6,821,194.

(51) Int. Cl.
*B24B 27/00* (2006.01)

(52) U.S. Cl. ..... 451/350

(58) Field of Classification Search ..... 451/350, 451/353, 14, 15
See application file for complete search history.

(56) References Cited

U.S. PATENT DOCUMENTS 6,821,194 B1 * 11/2004 Troyer ..... 451/350

* cited by examiner

*Primary Examiner*—Lee D. Wilson
(74) *Attorney, Agent, or Firm*—Ramon L. Pizarro; Edwin H. Crabtree

(57) ABSTRACT

A tool for adjusting the position of a set of support wheels for a floor edger. The tool includes a body that supports a leading gage surface, an angle gage surface, and a pair of wheel setting surfaces, the wheel setting surfaces being spaced apart from one another and mounted from the trailing end of the body, the leading gage surface and the angle gage surface lying along a support plane, the wheel plane being at wheel support distance from the support plane.

16 Claims, 4 Drawing Sheets

FLOOR EDGER ADJUSTMENT TOOL

REFERENCE TO RELATED APPLICATIONS

This application is a continuation of my non-provisional application having Ser. No. 10/002,490, filed Nov. 14, 2001, now U.S. Patent No. 6,821,194, incorporated herein in its entirety by reference.

BACKGROUND OF THE INVENTION (a) Field of the Invention This invention generally relates to a tool and method for adjusting the height of the wheels of a floor sanding machine.

(b) Discussion of Known Art

The design of floor sanding machines has remained largely unchanged for many years. An example of such a machine is found in U.S. Pat. No. 5,890,954 to Barous, incorporated herein by reference. The weight of a floor sanding machines is typically supported on a set or pair of rear wheels and on the sanding disk that is mounted in front of, and between the wheels. This arrangement results in a sanding disk that rotates about an axis that is not normal or perpendicular to the plane of the floor being sanded. Additionally, the sanding disk has a sanding surface that is on a planar surface or slightly conical surface centered about the axis of rotation of the sanding disk. This geometry crates a sanding contact area along the leading edge of the edger.

The sanding contact area for an edger is determined by the diameter and sanding surface of the sanding disk and the shape of the sanding surface of the sanding disk. Typically, the sanding disk will include a support surface that is used to support the sanding material. This sanding support surface is generally planar and defined by an area made of a soft rubber material. With use, the support surface and the sanding surface, which follows the support surface, may become slightly conical or even spherical. Also, vibrations and wear alter the orientation or angle of the support surface. Therefore, the orientation or angle of the support surface relative to the wheels must be adjusted to compensate for these changes.

Historically, the adjustment of the support surface relative to the wheels has been carried out by trial and error. The technician would adjust the height of the support of the wheels relative to the frame or body of the edger until the correct angle of the support surface relative to the floor is achieved. Unfortunately, the trial and error method requires many, time consuming, iterations before the technician can actually arrive at the proper setting. Accordingly, there remains a need for a system or method that allows the quick adjustment of the wheels of a floor edger to achieve the proper setting of the sanding surface.

SUMMARY

It has been discovered that the problems left unanswered by known art can be solved by providing a tool that allows a technician to gage or set the proper height of the wheels of a floor edger, the floor edger being of the type having a pair of wheels, casters or other support assemblies that set or determine the angle of a support surface for a sanding disk relative to the floor, the tool includes a body supporting a leading gage surface, an angle gage surface, and a pair of wheel setting surfaces. The body may be formed by a frame of one-piece construction or include adjustable components that will allow the user to select the desired angle for the wheels or supports and then adjust the wheels or supports to translate this angle to the support surface.

According to one example of the invention, the body consists of an angled, V-shaped frame formed by a pair of legs joined at a vertex area. The vertex area of the V-shaped frame will support the leading gage surface. The angle gage surface will extend across the legs that form the V-shaped frame, and the pair of wheel setting surfaces are mounted at or near the ends of the legs of the V-shaped frame. It is also contemplated that this example will include wheel guides that will help restrain the wheels at a desired position to ensure that the wheel setting surfaces make appropriate tangential contact with the wheels.

In addition to the above example, it is contemplated that the disclosed invention may be practiced by way of numerous examples. In addition to the above example, it is contemplated that the body may be a single, generally flat sheet of material, preferably stiff or generally rigid material. Also, it is contemplated that if a V-shaped frame is used, that each of the legs may be adjustable, meaning that they may extend by way of a telescoping mechanism or by way of frame components that clamp the legs at desired locations along the legs.

Additionally, it is contemplated that the leading gage surface may be adjustable to accommodate or engage different types of support surfaces. For example, a rest or a pair of engagement arms that engage the wheel that contains the support surface may be used to index the position of the frame of the tool. Similarly, an indexing arm may be positioned on a part of the structure of the housing found around the disk that includes the support surface or even the body of the edger.

Still further, it is contemplated that the angle gage surface may be adjustable to allow the user to select the angle at which the support surface will be set. A similar result may be achieved by providing adjustments for the pair of wheel setting surfaces.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
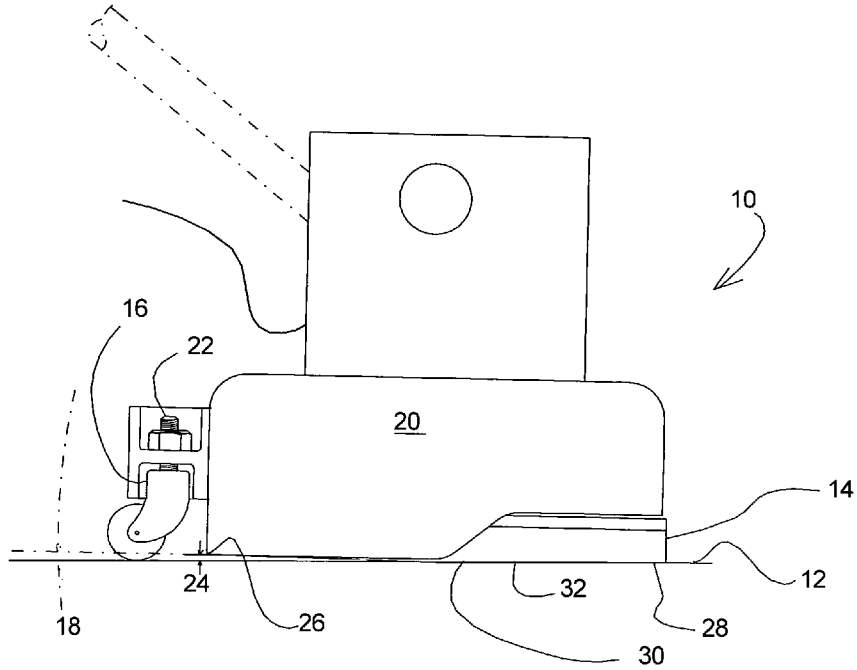
FIG. 1 is a side view of a floor edger. The view illustrating the general arrangement of the sanding disk and the relationship of the wheels and the angle of sanding disk established by the wheel height.

Turning now to FIG. 1 where a floor edger 10 has been illustrated on a floor surface 12, or floor to be sanded. FIG. 1 illustrates the position of the sanding disk 14 relative to the floor 12 to be sanded. As illustrated, the sanding disk 14 is at a sanding angle 18 to the floor 12. Furthermore, the weight of the floor edger 10 is supported on the floor by the sanding disk 14 and a set of adjustable wheels 16. The adjustable wheels 16 are mounted against a housing 20 or casting that is part of the floor edger 10. The adjustability of the wheels 16 pertains to the adjustability of the length of the wheel support 22, which determines the height 24 or distance from the floor 12 that the wheels 16 support the rear end 26 of the housing 20. By lifting the rear end 26 from the floor 12, the sanding disk 14 is tilted at an angle to the floor 12.

The weight of the floor edger 10 is supported by the wheels 16, or another support device, such as the caster-less support illustrated in U.S. Pat. No. 5,890,954, and the sanding disk 14. The sanding disk 14 includes a rotatable disk 28 with a support surface 32 for supporting a sanding element 30, such as adhesive-backed sandpaper or a bolted-on sanding element. The support surface 32 is typically made of a resilient material, such as rubber. An example of this sanding disk is illustrated in U.S. Pat. No. 2,114,967, to H. L. Myers, incorporated herein in its entirety by reference. The sanding disk has been adapted for use with an edging machine, such as the edging machine described in U.S. Pat. No. 1,951,105 to Myers, incorporated herein in its entirety by reference.

Figure 2:
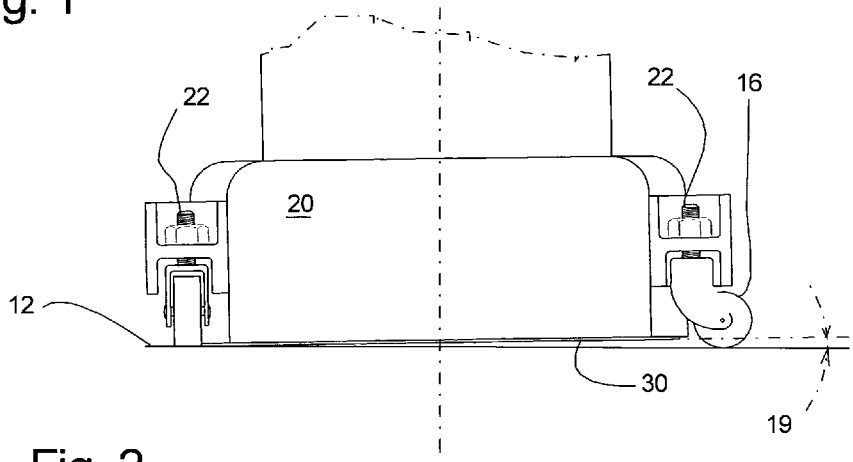
FIG. 2 is an end view, looking at the back of the edger illustrated in FIG. 1, the view showing the wheels and angle adjustments that can be accomplished with the wheels.

Importantly, the rotatable disk 28 will be supported at a sanding angle 18 relative to the floor to being sanded or finished. The sanding angle 18 will position the support surface 32, which determines the orientation of the sanding element 30. The sanding angle 18 allows the sanding element 30 to contact the floor surface 12 in a parallel manner to the desired or finished floor surface. The sanding angle is thus determined by the height at which the wheels or wheel support 22 hold the rear end 26 of the floor edger. In order to set this angle, the disclosed tool 34 for adjusting the position of the support wheels 16 of the floor edger 10. As illustrated in FIGS. 1 and 2, the edger has a casing or housing 20 that is attached to or includes the wheel supports 22.

Figure 3:
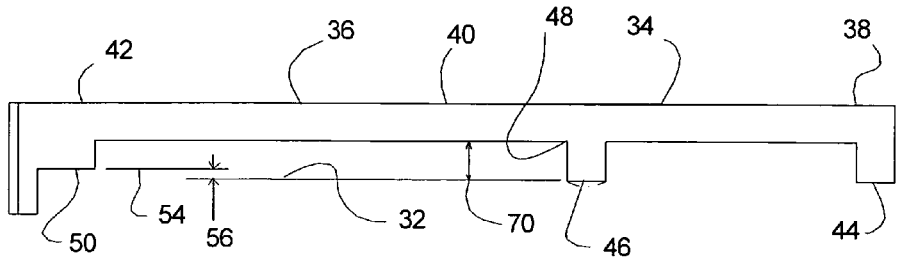
FIG. 3 is a side view of an example of the disclosed tool. The view illustrating examples of the contact surfaces used for indexing the wheel height and the wheel contact surfaces used to gage the wheel height.

Turning now to FIGS. 2 and 3, it will be understood that in order to allow a user, technician, to adjust the support height 24 of the rear end 26 of edger 10, the tool 34 includes a body 36 with a leading end 38, a mid-portion 40, and a trailing end 42. Mounted from the leading end 38 will be a leading gage surface 44. The leading gage surface may be rounded or flat, but has been illustrated as being generally flat.

Figure 4:
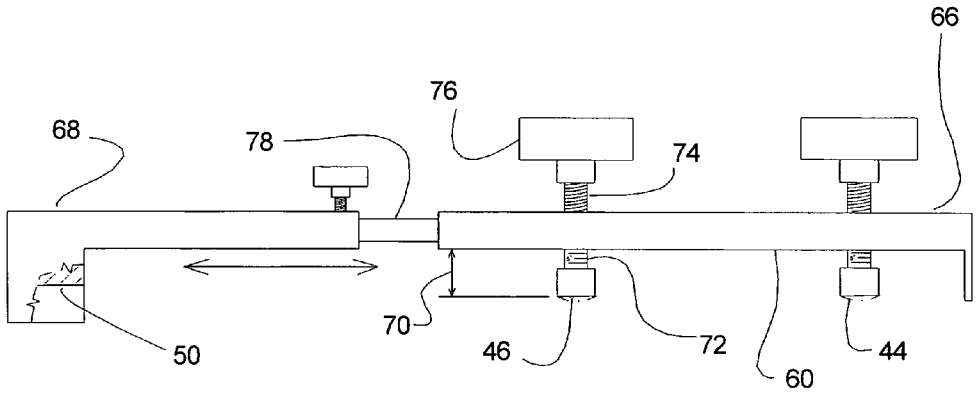
FIG. 4 is a side view of yet other examples of variations of the disclosed tool.

Also illustrated in FIGS. 3 and 4, is an angle gage surface 46, which is mounted from the body 36 at a location 48 between the leading end 38 and the trailing end 42 of the body 36. Referring now to FIGS. 3, 4, 5 and 6, it will be understood that the tool 34 includes a pair of wheel setting surfaces 50, the wheel setting surfaces 50 being spaced apart from one another and mounted from the trailing end 42 of the body 36 of the tool 34.

Figure 5:
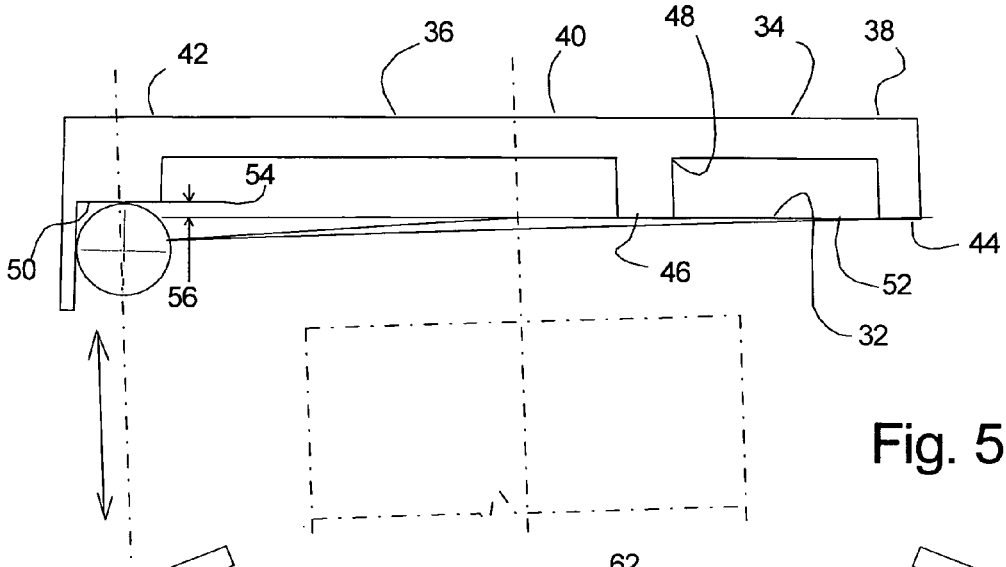
FIG. 5 is a schematic view of the edger in an upside down position, and illustrates the placement of an example of. The disclosed tool over the sanding disk and wheels of the edger while adjusting the wheel height.

As shown on FIG. 5, it is contemplated that the leading gage surface 44 and the angle gage surface 46 will lie along a support plane 52. Additionally, the pair of wheel setting surfaces 50 will lie on a wheel plane 54. It is contemplated that the wheel plane 52 will be at a wheel support height 56 from the support plane 52.

Figure 6:
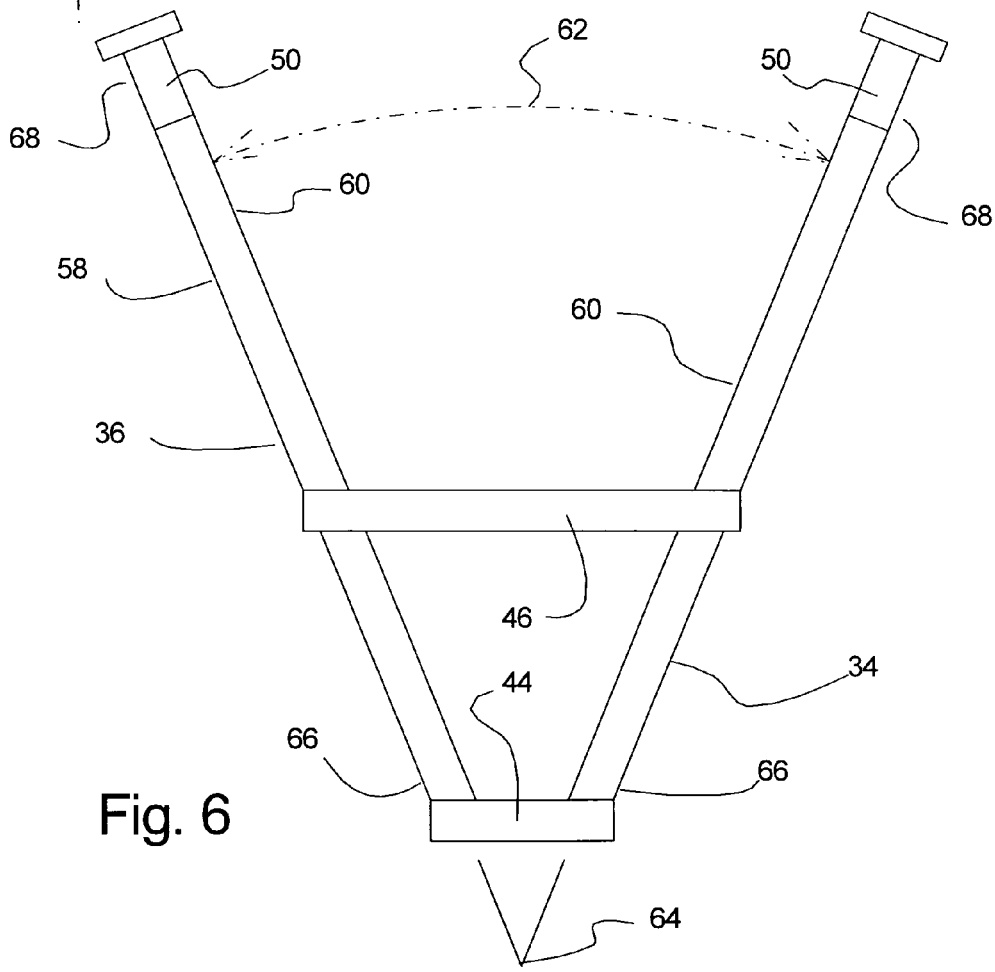
FIG. 6 is a plan view of the tool illustrated in FIG. 3.

Turning once again to FIG. 6, it will be understood that in one example of the tool 34 the body 36 is defined by a V-shaped frame 58. In this example, the V-shaped frame 58 will include a pair of legs 60 that have joined at an angle 62 to one another near a vertex point 64. Each of the legs 60 will include a first end 66 and a second end 68. The first ends 66 of the legs 60 being closest to one another near the vertex point 64. As illustrated in FIG. 6, the vertex point 64 will be near the leading end 38 of the body 36, while the second end 68 of the legs define the trailing end 42 of the body 36.

Turning once again to FIGS. 3 and 4, it will be understood that it is contemplated that the angle gage surface 46 will be mounted from the body 36, at a distance 70 from the body 36. FIG. 4 shows that the distance 70 can be made adjustable by providing an adjustable support 72, such as the threaded support 74 which is adjusted by turning the knob 76. It has also been illustrated that the leading gage surface 44 can be made adjustable in a similar manner that the angle gage surface can be made adjustable.

Figure 7:
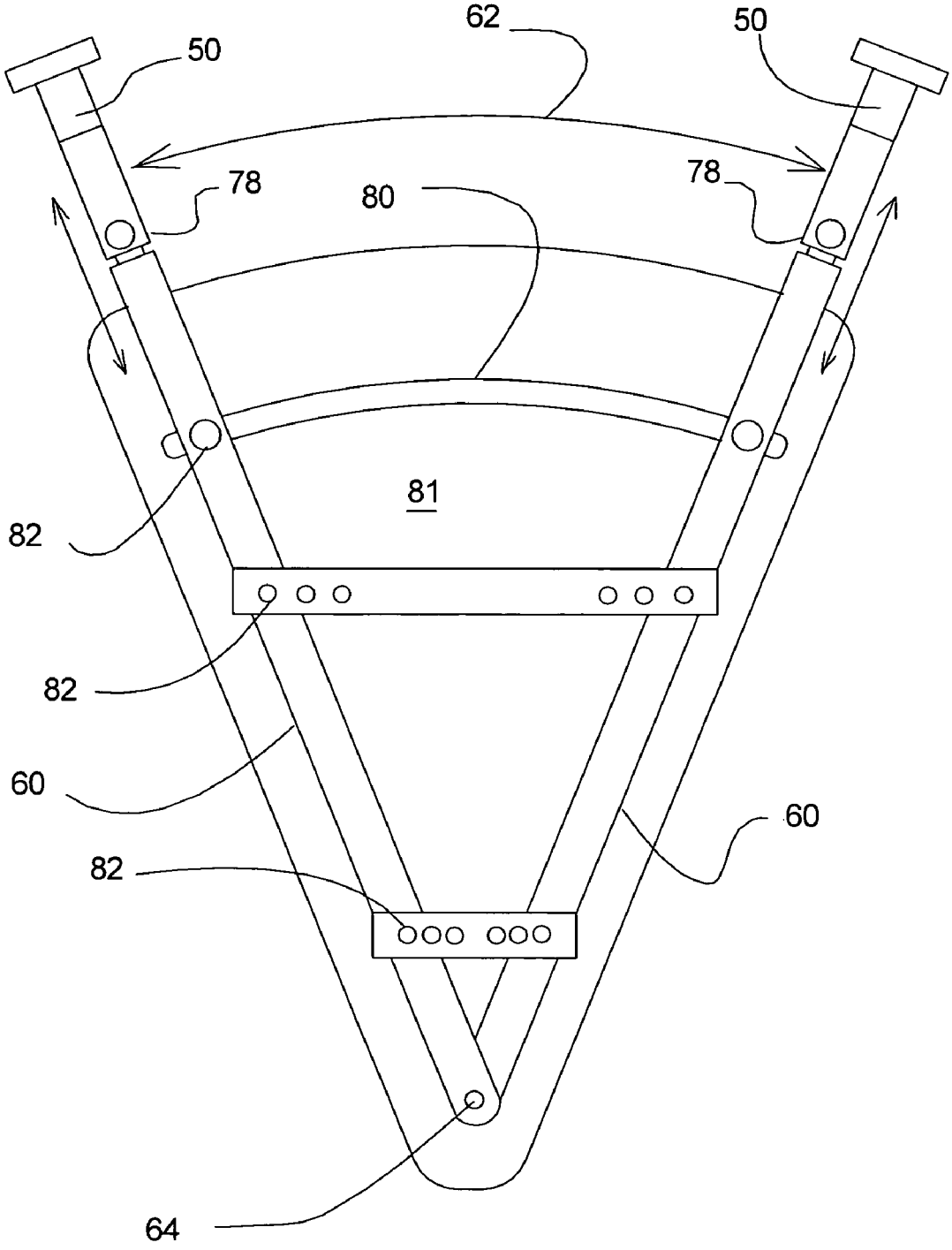
FIG. 7 illustrates another example of the invention.

Turning to FIGS. 4 and 7 it will be understood that it is contemplated that the legs 60 can be made of adjustable length by simply including a telescoping mechanism 78 that allows the user to set the length of the legs 60 to accommodate different size edgers or sanders. Additionally, as illustrated in FIG. 7, it is contemplated that the angle 62 between the legs 60 can be made adjustable by providing a track 80 and plate 81 with pinning or setting points 82 that allow the angle 62 to be adjusted to accommodate different size machines. Additionally, it is contemplated that graduations or other markings may be used on the tool to allow the user to decide to set the support surface at a tilted angle 19 to the floor 12, meaning that one of the wheels supports the rear end 26 of the edger 10 at a greater distance from the floor 12 than the other wheel. This would be done in order to counteract the torsional loads reacted on the turning sanding disk 14 and imposed on the person using the edger 10 while the edger 10 is in use.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A tool for adjusting the position of a set of support wheels for a floor edger, the edger having a rotatable disk with a support surface for supporting a sanding element, the tool comprising:

a body, the body having a leading end, a mid-portion and a trailing end;

a leading gage surface, the leading gage surface being mounted from the leading end of the body;

an angle gage surface, the angle gage surface being mounted through from the body at a location between the leading end of the body and the trailing end of the body, the leading gage surface and the angle gage surface being of one-piece unitary construction; and a pair of wheel setting surfaces, the wheel setting surfaces being spaced apart from one another and mounted from the trailing end of the body, the leading gage surface and the angle gage surface lying along a support plane, and said pair of wheel setting surfaces lying on a wheel plane, the wheel plane being at wheel support distance from the support plane.

2. A tool according to claim 1 wherein said body comprises a V-shaped frame, said V-shaped frame being defined by a pair of legs joined at an angle to one another near a vertex point, each of the legs having a first end and a second end, the first ends of the legs being closest to one another near the vertex point, the vertex point being near the leading end of said body, the second end of said legs defining the trailing end of said body.

3. A tool according to claim 2 wherein said legs are of adjustable length.

4. A tool according to claim 1 wherein said body comprises a V-shaped frame, said V-shaped frame being defined by a pair of legs joined to one another near a vertex point, each of the legs having a first end and a second end, the first ends of the legs being closest to one another near the vertex point, the vertex point being near the leading end of said body, the second end of said legs defining the trailing end of said body.

5. A tool according to claim 1 wherein said angle gage surface is mounted from said body at a distance from said body.

6. A tool according to claim 5 wherein said distance is adjustable.

7. A tool for adjusting the position of a pair of support wheels for a floor edger the edger having a casing that includes wheel supports, the edger further having a rotatable disk with a support surface for supporting a sanding element, the rotatable disk being supported at a sanding angle to a floor to be sanded, the angle being defined by the position of the wheels relative to the casing, the tool comprising:

a body, the body having a leading end, a mid-portion and a trailing end;

a leading gage surface, the leading gage surface being mounted from the leading end of the body;

an angle gage surface, the angle gage surface being mounted from the body at a location between the leading end of the body and the trailing end of the body, the leading gage surface and the angle surface being of unitary one-piece construction; and a pair of wheel setting surfaces, the wheel setting surfaces being spaced apart from one another and mounted from the trailing end of the body and being supported with a threaded connector rom the body to allow adjustment of the distance of the wheel setting surfaces from the body, the leading gage surface and the angle gage surface lying along a support plane, and said pair of wheel setting surfaces lying on a wheel plane, the wheel plane being at a tool angle to the support plane, the tool angle being equal to the sanding angle.

8. A tool according to claim 7 wherein said body comprises a V-shaped frame, said V-shaped frame being defined by a pair of legs joined at an angle to one another near a vertex point, each of the legs having a first end and a second end, the first ends of the legs being closest to one another near the vertex point, the vertex point being near the leading end of said body, the second end of said legs defining the trailing end of said body.

9. A tool according to claim 8 wherein said legs are of adjustable length.

10. A tool according to claim 7 wherein said angle gage surface is mounted from said body at a distance from said body.

11. A tool according to claim 10 wherein said distance is adjustable.

12. A method for adjusting the position of a pair of support wheels on a floor edger, the method comprising:

providing a floor edger having a rotatable disk with a support surface for supporting a sanding element and a housing supporting a pair of adjustable wheels, the wheels cooperating with the rotatable disk to support the floor edger while the edger is in operation, the rotatable disk having a perimeter and a center;

providing a tool comprising:

a body, the body having a leading end, a mid-portion and a trailing end;

a leading gage surface, the leading gage surface being mounted from the leading end of the body;

an angle gage surface, the angle gage surface being mounted from the body at a location between the leading end of the body and the trailing end of the body; and a pair of wheel setting surfaces, the wheel setting surfaces being spaced apart from one another and mounted from the trailing end of the body, the leading gage surface and the angle gage surface lying along a support plane, and said pair of wheel setting surfaces lying on a wheel plane, the wheel plane being at wheel support distance to the support plane;

placing the leading gage surface against the support surface of the disk at a location near the perimeter of the disk, urging the gage angle surface against the support surface of the disk; and adjusting the wheels by moving the wheels until the wheels are tangent to the wheel setting surfaces.

13. A method according to claim 12 wherein said body comprises a V-shaped frame, said V-shaped frame being defined by a pair of legs joined to one another near a vertex point, each of the legs having a first end and a second end, the first ends of the legs being closest to one another near the vertex point, the vertex point being near the leading end of said body, the second end of said legs defining the trailing end of said body.

14. A method according to claim 13 wherein said legs are of adjustable length.

15. A method according to claim 12 wherein said angle gage surface is mounted from said body at a distance from said body.

16. A method according to claim 15 wherein said distance is adjustable.

* * * * *